United States Patent [19]

Cummins et al.

[11] Patent Number: 4,552,506

[45] Date of Patent: Nov. 12, 1985

[54] OPENER MECHANISM AND SYSTEM UTILIZING SAME

[75] Inventors: Michael A. Cummins, Mt. Clemens; Thomas M. Powell, Dryden, both of Mich.

[73] Assignee: GMFanuc Robotics Corporation, Troy, Mich.

[21] Appl. No.: 573,430

[22] Filed: Jan. 24, 1984

[51] Int. Cl.[4] ..... B66C 1/00

[52] U.S. Cl. ..... 414/735; 414/917; 901/15

[58] Field of Search ..... 901/1, 43, 15; 414/729, 414/735, 917

[56] References Cited

U.S. PATENT DOCUMENTS

| | | | |
|---|---|---|---|
| 3,995,756 | 12/1976 | Hjelm | 901/15 X |
| 4,342,535 | 8/1982 | Bartlett et al. | 901/43 X |
| 4,345,864 | 8/1982 | Smith, Jr. et al. | 901/15 X |

*Primary Examiner*—William E. Wayner
*Attorney, Agent, or Firm*—Brooks & Kushman

[57] ABSTRACT

A mechanism for opening a vehicle closure such as a deck lid or hood is positioned at a work station such as a paint booth and includes interconnected gripper and floating arms mounted for rotary movement between a parked position, a pick-up position and a full-open position corresponding to an open position of the closure. The closure is utilized as a member of a four-bar linkage. Arm control linkage provides a two-stage harmonic motion including smooth acceleration and deceleration of the closure after a gripper mechanism mounted on the free end of the gripper arm has received the closure at the pick-up position. A fixture is mounted on the closure for engagement by a pair of opposing fingers of the gripper mechanism. Gripper control linkage is connected to the arm control linkage to open and close the fingers of the gripper mechanism in synchronism with the motion of the gripper arm. A system utilizing the opener mechanism includes a hydraulic power supply and a manifold assembly. The manifold assembly includes metering valves which control the cycle time. A solenoid valve controls a rotary actuator of the opener mechanism. Magnetic proximity switches provide status signals to a programmable controller of the system which controls the solenoid valve. The switches indicate different positions of the floating and gripper arms.

21 Claims, 18 Drawing Figures

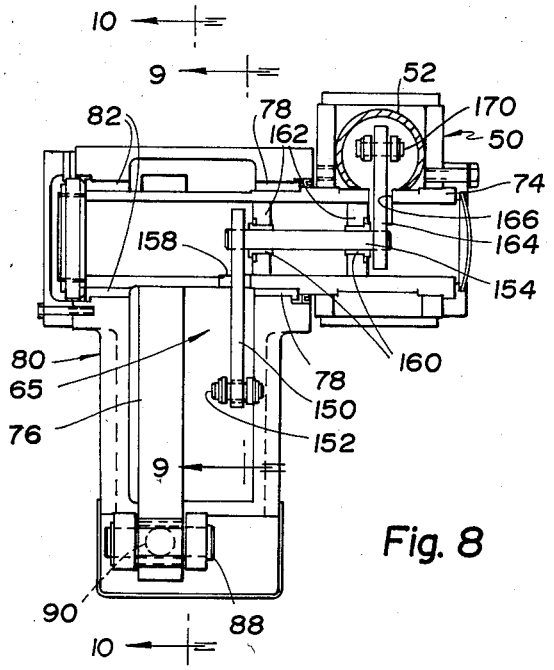
Fig. 8
Fig. 9
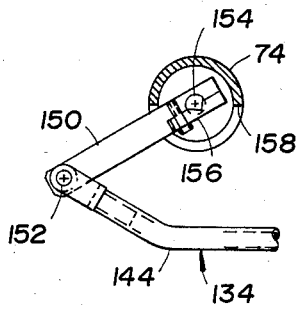
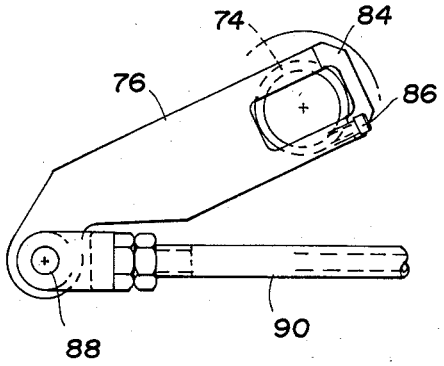
Fig. 10

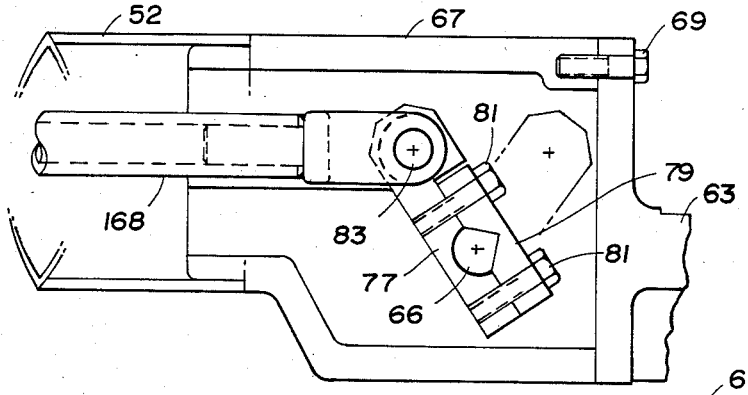
Fig. 11
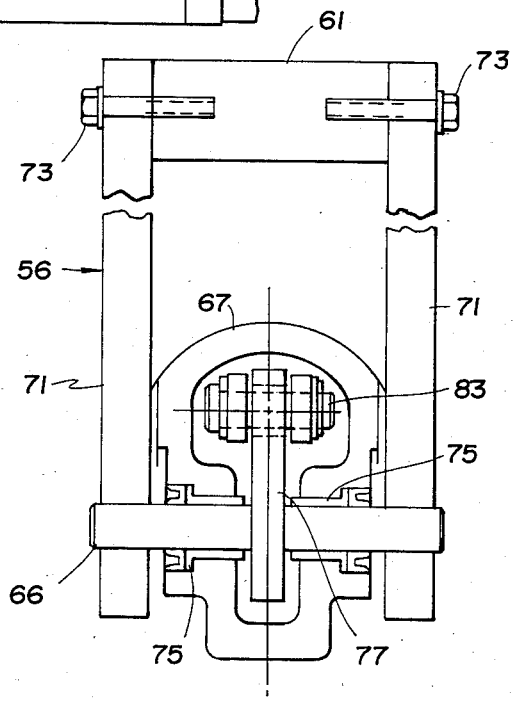
Fig. 12
Fig. 13
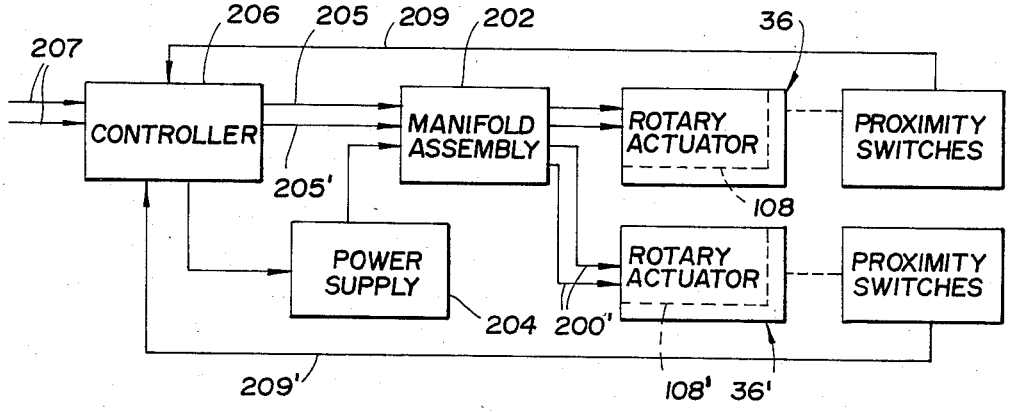

OPENER MECHANISM AND SYSTEM UTILIZING SAME

TECHNICAL FIELD

This invention relates to mechanisms and systems for moving closures of vehicle bodies and, in particular, to mechanisms and systems for automatically moving hood and/or deck lids of vehicles bodies between open and closed positions.

BACKGROUND ART

U.S. Pat. No. 4,342,535 to Bartlett et al and Akeel et al U.S. Pat. No. 4,342,536 disclose apparatus for opening and closing doors of a vehicle body during the painting of the vehicle body by a robot. The apparatus includes primary and auxiliary arms mounted on a carriage. The apparatus is taught to follow the vehicle body as it moves through a painting station. During the tracking operation, the secondary arm of the apparatus is extended to engage a fixture mounted to a door of the vehicle body. The door is opened by driving the fixture through an arc predetermined by the relationship between the fixture and the door hinge axis. The apparatus includes hydraulic motors, servo valves, resolvers, gear boxes, a pneumatic cylinder and a control valve. Considerable electronics are involved in the control portion of the apparatus to provide continuous feedback and command signals. The electronics also contains therewithin the various paths corresponding to the various body style door configurations. Numerous electrical, hydraulic and pneumatic lines extend to the moving parts of the apparatus.

The automatic opening and closing of various closures of vehicle bodies such as hood or deck lids presents a problem in that the closure often does not rotate about a single hinge axis between its closed and fully-open positions.

DISCLOSURE OF THE INVENTION

An object of the present invention is to provide a mechanism and a system utilizing the mechanism for moving a closure of a vehicle body at a work station wherein the mechanism includes interconnected first and second arms and arm control linkage for smoothly accelerating and decelerating the second arm after a gripper mechanism mounted on a free end of the second arm has received the closure so that the closure is moved in a relatively smooth fashion.

Another object of the present invention is to provide a system including a mechanism for moving a closure of a vehicle body at a work station wherein a control mechanism of the system is relatively simple, is compatible with digital control systems and does not require the introduction of high power level electrical circuits to the work station nor numerous electrical, hydraulic nor pneumatic lines connected to any moving members of the mechanism.

Yet another object of the present invention is to provide a mechanism for moving a closure of a vehicle body at a work station wherein a gripper mechanism and first and second interconnected arms of the mechanism are adaptable to different vehicle body styles and various tolerances.

In carrying out the above objects and other objects of the present invention, the mechanism for moving the closure of a vehicle body at a work station along a path between open and closed positions includes a base and first and second arms. The first arm is mounted on the base for rotary movement about a first pivot axis. The second arm is mounted on the first arm for rotary movement about a second pivot axis between a parked position and a pick-up position corresponding to closed positions of the closure. The second arm also moves with the first arm between the pick-up position and the full-open position corresponding to the open position of the closure. The opener mechanism also includes a gripper mechanism mounted on a free end of the second arm and is adapted for receiving and releasing the closure in the pick-up position. A motor, including a rotatable actuator shaft is connected to arm control linkage which transfers rotary motion of the actuator shaft to rotate the second arm between the parked and pick-up positions. The arm control linkage also transfers rotary motion to rotate the first and second arms between the pick-up and full-open positions. The gripper mechanism follows the path of the closure between the open and closed positions after receiving the closure.

A system for opening and closing closures of vehicle bodies along a path at a work station includes a base and first and second arms. The first arm is mounted on the base for rotary movement about a first pivot axis and a second arm is mounted on the first arm for rotary movement about a second pivot axis between a parked position and a pick-up position corresponding to closed positions of the closure. The second arm also moves with the first arm between the pick-up position and the full-open position corresponding to an open position of the closure. The mechanism also includes a gripper mechanism mounted on a free end of the second arm and is adapted for receiving and releasing the closure in the pick-up position. A motor, including a rotatable actuator shaft is connected to arm control linkage which transfers rotary motion of the actuator shaft to rotate the second arm between the parked and pick-up positions. The arm control linkage also rotates the first and second arms between the pick-up and full-open positions. The gripper mechanism follows the path of the closure between the open and closed positions after receiving the closure. A control means is provided for controlling the operation of the motor and a feedback means is associated with the first and second arms for providing feedback signals to the control means.

Preferably, the arm control linkage translates rotation of the actuator shaft at a substantially constant angular velocity to movement of the gripper mechanism along the path of the closure at a substantially sinusoidal velocity. In this way, the gripper mechanism is accelerated and decelerated to move the closure in a relatively smooth fashion after the gripper mechanism receives the closure.

The arm control linkage includes a first crank mounted on the actuator shaft for movement about the first pivot axis. The second arm is accelerated and decelerated between the parked and pick-up positions to enable the gripper mechanism to gently receive and release the closure at the pick-up position.

Also, preferably, the arm control linkage includes a second crank having one end thereof mounted on the first crank for pivotal movement about a third pivot axis between the parked and pick-up positions. The first and second cranks rotate in unison about the first pivot axis between the pick-up and full-open positions. The gripper mechanism includes a pair of opposing fingers movable between open and closed positions and are adapted to receive and pivotally retain therebetween at least part of the closure. Gripper control linkage is provided which is operatively associated with the arm control linkage to open and close the fingers in synchronism with the motion of the two arms.

Yet still preferably, the base is adapted to be mounted at the work station so that the longitudinal axes of the first and second arms are substantially parallel to the path taken by the closure as the vehicle body moves into the work station.

The mechanism and system of the present invention require relatively simple controls to operate in a smooth fashion. The system and mechanism have a relatively low cost, yet are adaptable to various body styles and tolerances.

The above objects and other objects, features and advantages of the present invention are readily apparent from the following detailed description of the best mode for carrying out the invention when taken in connection with the accompanying drawings.

BRIEF DESCRIPTION OF THE DRAWINGS

FIG. 8 is an end view taken along the lines 8—8 of FIG. 3;

FIG. 9 is a view, partially broken away and in cross-section, taken along the lines 9—9 of FIG. 8;

FIG. 10 is a view, partially broken away, taken along the lines 10—10 of FIG. 8;

FIG. 11 is a side view, partially broken away, of a gripper mechanism illustrating two operative positions, one of which is shown by phantom lines;

FIG. 12 is an end view, partially broken away, of the gripper mechanism taken along the lines 12—12 of FIG. 11;

FIG. 13 is a schematic diagram of a system showing the opener mechanism combined with control components;

BEST MODE FOR CARRYING OUT THE INVENTION

Figure 1:
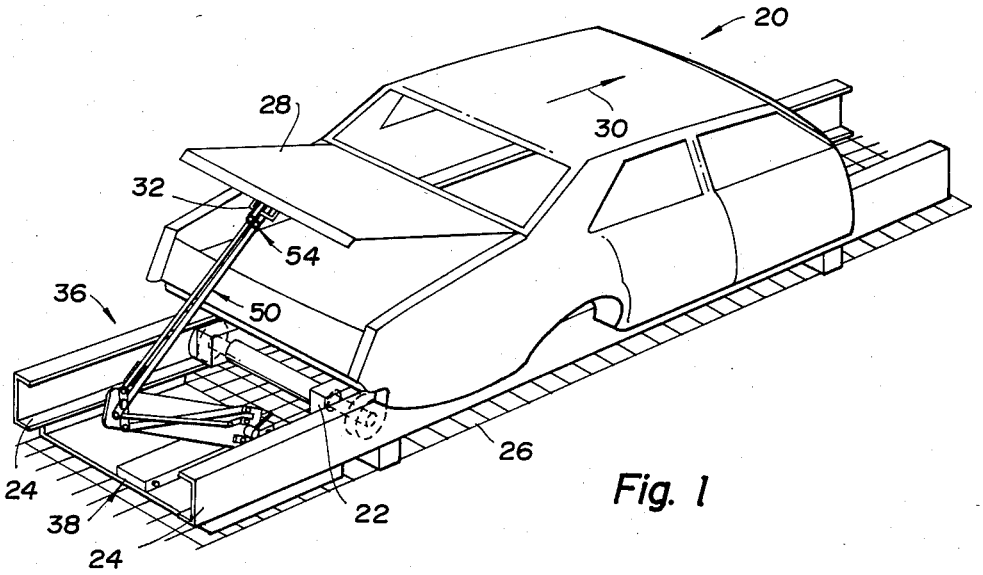
FIG. 1 is a perspective view showing a sheet metal vehicle body positioned in a work station in relation to an opener mechanism made in accordance with the present invention.

Referring to the drawings, and more particularly to FIG. 1, a vehicle body generally indicated at 20, made of sheet metal, is shown mounted on a carrier 22 and being conveyed along tracks 24 to a conventional paint booth structure a part of which is shown at 26. A traveling conveyor causes the vehicle body 20 and the carrier 22 to move in a direction indicated by arrow 30 into the paint booth and into a position for painting the vehicle body 20.

A fixture 32, as shown in FIG. 1, is removably mounted to a free end of a deck lid 28 of the vehicle body 20. The fixture 32 is also removably mounted to the free end of a hood 34 of the vehicle body 10 as schematically shown in FIGS. 14 through 18.

An opener apparatus or mechanism of the present invention is generally indicated at 36 and opens the deck lid 28 when positioned in the work station at the rear of the vehicle body 20 or opens the vehicle hood 34 when positioned in the work station at the front of the vehicle body 10. The opener mechanism as positioned at the front of the vehicle body 20 is given a primed designation and is schematically shown in FIGS. 14 through 18.

The opener mechanism 36 seizes the fixture 32 and moves its associated closure along an arcuate path to an open position as shown in FIG. 1, so that, for example, the inside of the closure can be painted by a paint robot (not shown) during the painting operation of the vehicle body 20. Thereafter, the closure is closed by the opener mechanism 36 and the fixture 32 is released. The mechanism 36 then returns to a parked position to await the arrival of another vehicle body for repeating the opening and closing operation.

Figure 2:
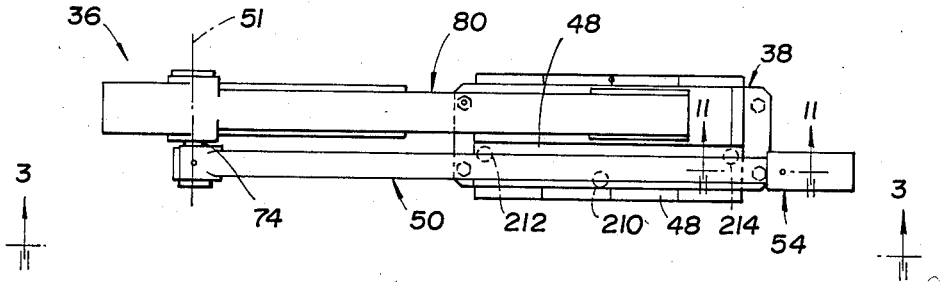
FIG. 2 is a top plan view of the mechanism of the present invention.
Figure 3:
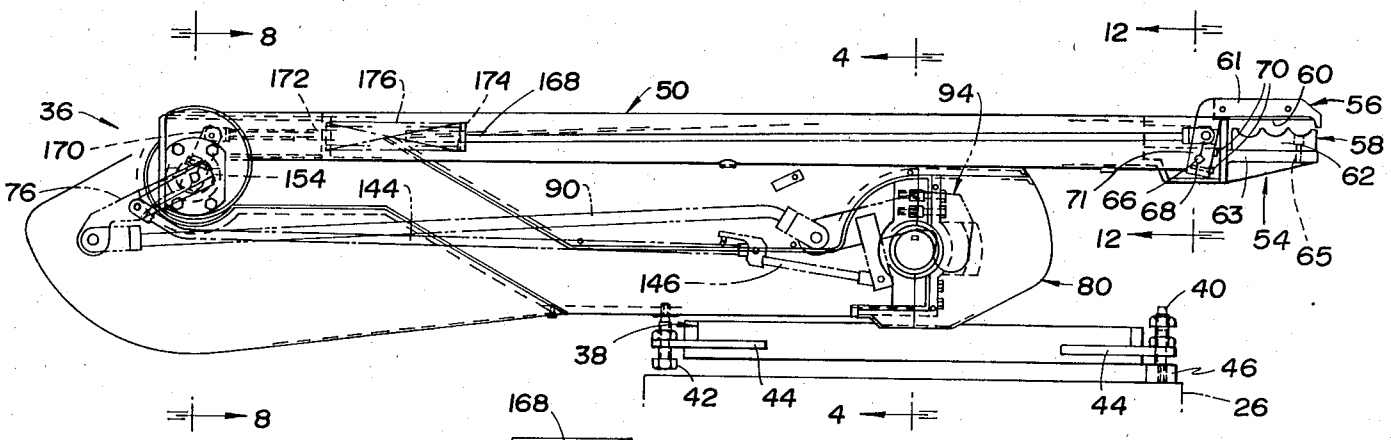
FIG. 3 is a side elevational view taken along the lines 3—3 of FIG. 2 and illustrating a parked position of the mechanism.
Figure 4:
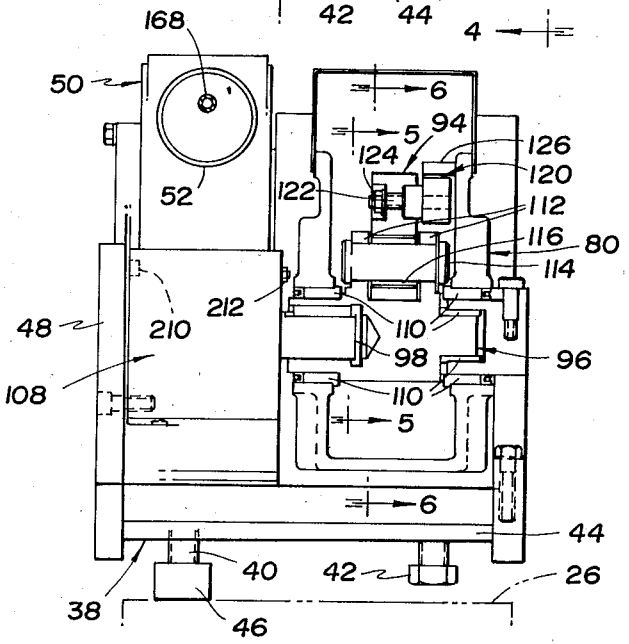
FIG. 4 is an end view of the mechanism taken along the lines 4—4 of FIG. 3.

Referring now to FIGS. 2 through 4, the opener mechanism 36 includes an aluminum base or housing, generally indicated at 38. The housing 38 is adjustably mounted to the booth structure 22 by leveling screws and bolts 40. The leveling screws 40 extend through a lower plate 44 of the housing 38 and into mounts 46 which are fixedly secured to the booth structure 26 such as by welding. The housing 38 also includes aluminum side plates 48.

Figure 14:
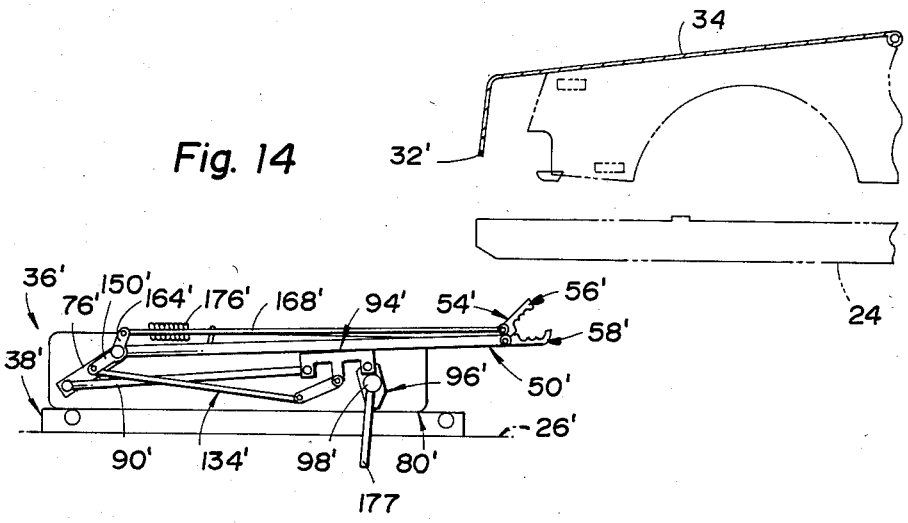
FIG. 14 is a schematic diagram of the opener mechanism for a hood in its parked position, shown relative to a vehicle body with an operating fixture attached thereto.
Figure 16:
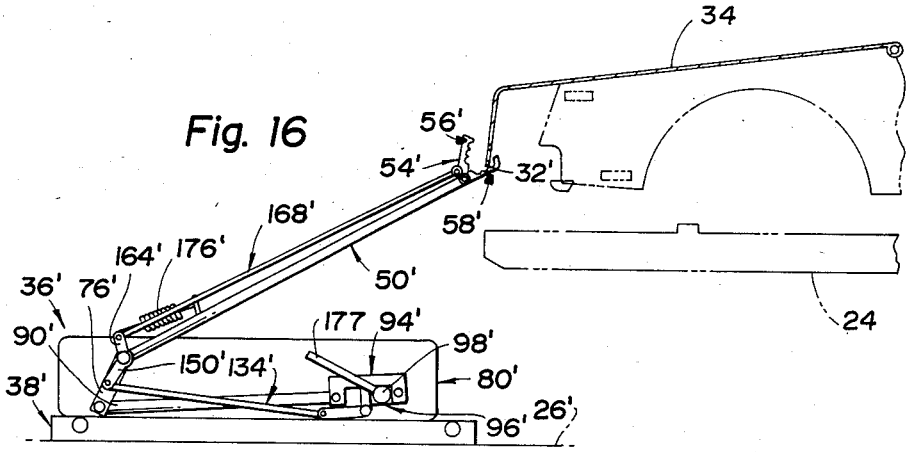
FIG. 16 is a view similar to FIG. 14 with the opener apparatus in its pick-up position.

The opener mechanism 36 also includes a hollow gripper arm, generally indicated at 50. The gripper arm 50 is mounted for rotary movement about a pivot axis 51 of a floating arm 80 between a parked position as shown in FIGS. 2, 3 and 14 and a pick-up position as shown in FIG. 16. In the parked and pick-up positions the closure is closed.

The gripper arm 50 includes a hollow aluminum elongated tube 52 which houses gripper control linkage which will be described in greater detail hereinafter.

Figure 18:
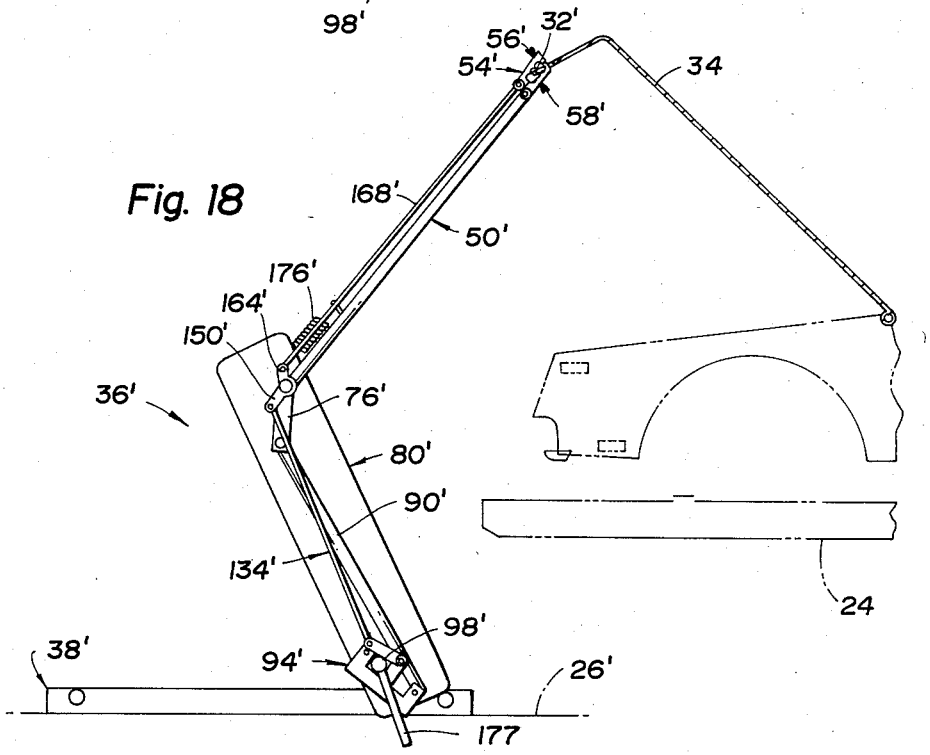
FIG. 18 is a diagram similar to FIG. 14 with the opener mechanism in its full-open position corresponding to the fully-open position of the hood of the vehicle body.

A gripper mechanism, generally indicated at 54, is mounted on the free end of the gripper arm 50 as shown in FIG. 2. The gripper mechanism 54 is adapted to receive, retain and release the fixture 32 as the gripper arm 50 moves between the pick-up position as shown in FIG. 16 and the full-open position as shown in FIG. 18. The gripper mechanism 54 includes upper and lower opposed fingers, generally indicated at 56 and 58, respectively. The upper finger 56 includes a non-sparking, wear-resistant plastic plate 60 mounted on an upper flange member 61 of the upper finger 56. The lower finger 58 includes a non-sparking, wear-resistant plastic scalloped block 62 fixedly mounted on a lower flange member 63 of the lower finger 56 by bolts, only one of which is shown at 65. As shown in FIG. 11, the flange member 63 is mounted to a hollow collar member 67 by bolts, only one of which is shown at 69. In turn, the collar member 67 is mounted at the free end of the tube 52.

The plastic plate 60 and the plastic block 62 receive and pivotally retain the fixture 32 therebetween in the closed position of the gripper mechanism 54 as shown in FIG. 3.

As shown in FIG. 12, the upper flange 56 includes a pair of spaced plates 71 which are bolted to the flange member 61 by bolts 73. A shaft 66 is pivotally supported on the collar member 67 by a pair of bushings 75. The plates 71 are mounted on the shaft 66 to rotate therewith by retainers 68 and mounting bolts 70 as shown in FIG. 3.

The gripper control linkage, which is disposed within the aluminum tube 52 includes a drive link 77 which is also mounted on the shaft 66 by a retainer 79 and bolts 81. The drive link 77 rotates the shaft 66 which, in turn, rotates the upper finger 56. The remainder of the gripper control linkage is pivotally connected to the drive link 77 by a pin 83.

The gripper arm 50 is pivotally mounted on the floating arm 80 by a shaft 74 which rotates with the gripper arm, as best shown in FIG. 8. The shaft 74, in turn, is mounted to a drive link 76 of arm control linkage to rotate therewith within the floating arm 80. The drive link 76 is mounted on the shaft 74 by a retainer 84 and a mounting screw 86, as best shown in FIG. 10. In turn, an intermediate portion of the shaft 74 is rotatably supported on the floating arm 80 by bushings 78. The opposite end of the shaft 74 is also rotatably supported within the floating arm 80 by bushings 82. A leveling screw 42 serves as a stop for limiting pivotal movement of the floating arm 80 as will be described in greater detail hereinbelow.

The floating arm 80 receives and retains therein the arm control linkage and parts of the gripper control linkage, generally indicated at 65. Other parts of the gripper control linkage 65 are contained within the shaft 74 and the tube 52.

Figure 6:
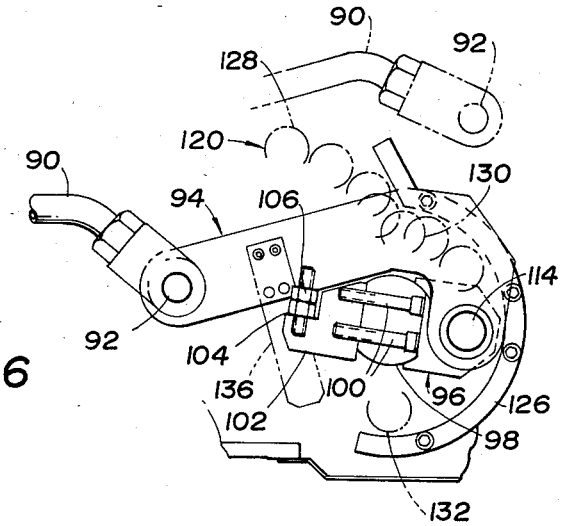
FIG. 6 is a side view, partially broken away, taken along the lines 6—6 of FIG. 4 and illustrating a number of different operative positions by phantom lines.
Figure 7:
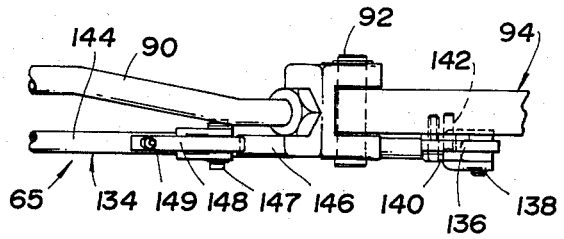
FIG. 7 is a top plan view, partially broken away, taken along the lines 7—7 of FIG. 5.

The drive link 76 is pivotally connected by a pin 88 to a drag link 90. In turn, the drag link 90 is pivotally connected by a pin and bearing connection 92 to one end of a bent crank, generally indicated at 94. The opposite end of the bent crank 94 is pivotally connected to a first stage crank, generally indicated at 96, which, in turn, is mounted on an actuator shaft 98 by a conventional square key arrangement. Mounting bolts 100 mount a secondary crank stop or part 102 of the first stage crank 96. The part 102 includes a stop bolt 104 which is adapted to engage a corresponding stop bolt 106 on the bent crank 94, as shown in FIG. 6. This engagement occurs in the pick-up position of the opener mechanism 20 as also shown in FIG. 16.

The actuator shaft 98 is a part of a rotary actuator, generally indicated at 108, which is mounted within the housing 38, as best shown in FIG. 4. The first stage crank 96 is supported for rotation within the floating arm 80 by bushings 110. The bent crank 94 is pivotally mounted between a pair of spaced, upwardly extending walls 112 of the first stage crank 96 on a bearing 116. A pin 114 extends through the walls 112 and supports the bearing 116.

The bent crank 94 supports a roller or follower, generally indicated at 120 for rotation. The follower 120 includes a shaft 122 which is secured to the crank 94 by a locking nut 124. The follower 120 rides along a guide or track 126, fixedly mounted within the floating arm 80. The track 126 constrains the follower 120 to follow the path indicated in phantom in FIG. 6. For example, in the parked position of the mechanism 20, the follower 120 is located at a position 128; in the fixture pick-up position, the follower 120 is in a position 130; and in the full-open position, the follower 120 is in a position 132. The track 120 also prevents the two stop bolts 104 and 106 from moving away from each other as the mechanism 20 moves from the full-open position to the fixture pick-up position.

The gripper control linkage 65 includes drag linkage, generally indicated at 134, which is pivotally connected to a rectangular plate 136 by a pin, washer and bushing assembly 138. The plate 136, in turn, is mounted on the bent crank 94 by screws 140 and pins 142.

Figure 5:
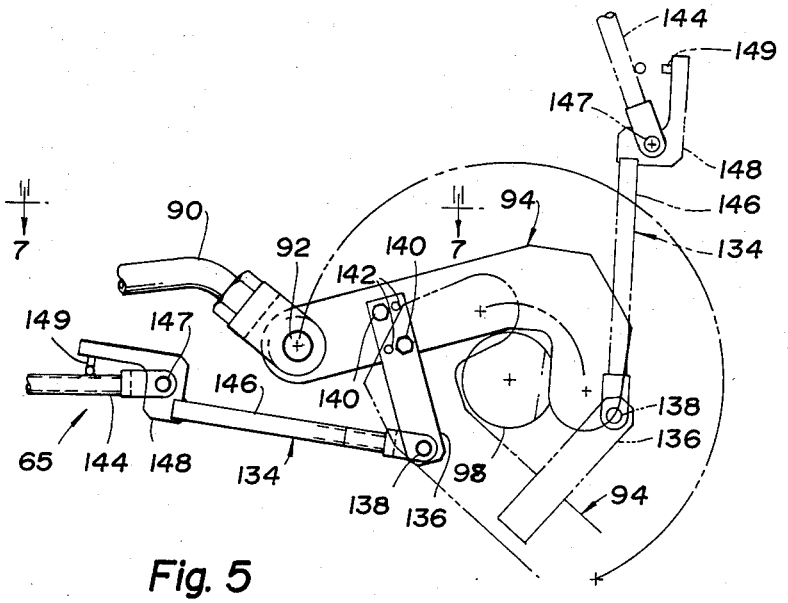
FIG. 5 is a side view, partially broken away, taken along the lines 5—5 of FIG. 4 and illustrating two operative positions of the mechanism, one of which is shown by phantom lines.

The drag linkage 134 includes a pair of links 144 and 146 which are pivotally connected by a pin 147 at an L-shaped bracket 148 which includes a stop 149. The bracket 148 comprises a joint of the drag linkage 134 which permits the drag linkage 134 to buckle, as shown in phantom in FIG. 5, during movement between the fixture pick-up position and the full-open position.

The link 144 of the drag link 134 is pivotally connected to a drive link 150 at its opposite end by a pin 152 as shown in FIGS. 8 and 9. In turn, the drive link 150 is mounted on one end of a shaft 154 to rotate therewith by a screw, washer and retainer assembly 156. The drive link 150 is allowed to rotate within the shaft 74 by a semi-circular slot 158 formed in the shaft 74. The shaft 154 is supported for rotary movement within the shaft 74 by a pair of spaced bushings 160 which, in turn, are supported within the shaft 74 by a pair of walls 162.

A second drive link 164 is mounted on the opposite end of the shaft 154 by a screw, washer and retainer assembly 155 for rotation with the shaft 154. The link 164 extends through a slot 166 formed in the shaft 74 to permit the second drive link 164 to rotate. In turn, the second drive link 164 is pivotally mounted to a drag link 168 by a pin 170 within the tube 52 which is also slotted as shown in FIG. 3. The drag link 168 is pivotally connected to the drive link 77 by the pin 83 and extends through an apertured plate 172 mounted in the tube 52. A mounting plate 174 is fixedly mounted on the drag link 168 at a location spaced from the plate 172. A spring 176 extends between the plates 172 and 174 to bias the upper finger 56 toward the lower finger 54.

The rotary actuator 108 comprises a pneumatic, electric or hydraulic drive unit with an approximately 360° range of travel as shown by the relative positions of an indicator 177 mounted on the actuator shaft 98' in FIGS. 14 through 18. The rotary actuator 108 is preferably hydraulically powered from a pair of hydraulic lines 200 (FIG. 13) which extend from a module in a manifold assembly 202 as shown in FIG. 13. The manifold assembly 202 includes a plurality of modules, one for each mechanism 36 and 36'. As previously mentioned, the mechanisms 36 and 36' are illustrated for opening a deck lid 28 and a front hood 34, respectively, of the vehicle body 20. The opening of both the deck lid 28 and the hood 34 may be accomplished substantially simultaneously. The mechanisms 36 and 36' are positioned in the work station so that they are located at the front and the rear of the vehicle body 20 and so that the longitudinal axes of their respective arms are substantially parallel to the paths taken by the closures when the vehicle body 20 moves into the work station.

Each module of the manifold assembly 202 comprises an electro-hydraulic, spring-centered, solenoid-operated four-way valve with manual override capability. Each module also includes a metering valve block for controlling the opening and closing velocities of the mechanism. The module further includes a fixed sandwich orifice which reduces start-up shock. A hydraulic power supply 204 provides hydraulic fluid under pressure to the manifold assembly 202.

The system utilizing the mechanisms 36 and 36' also includes a controller 206 which, in turn, controls one or more apparatus 36 and 36'. The controller 206 is responsive to signals, for example, from a robot controller (not shown) along lines 207. The controller 206 provides digital electrical signals to the valve of the particular module to be controlled along lines 205 or 205'. The controller 206 receives electrical feedback signals along the lines 209 to monitor the status of the arms 50 and 80 (i.e. whether in the parked, pick-up or full-open positions). Switches or sensors which preferably comprise hermetically-sealed, magnetic proximity switches provide the electrical feedback signals. As schematically shown in FIGS. 2 and 4, one such switch 210 indicates the parked position; a second such switch 212 indicates the pick-up position; and a third such switch 214 indicates the full-open position. The switches 210, 212 and 214 are configured as normally open switches with a common ground and include current-limited sensor circuitry.

OPERATION OF EACH MECHANISM

Figure 15:
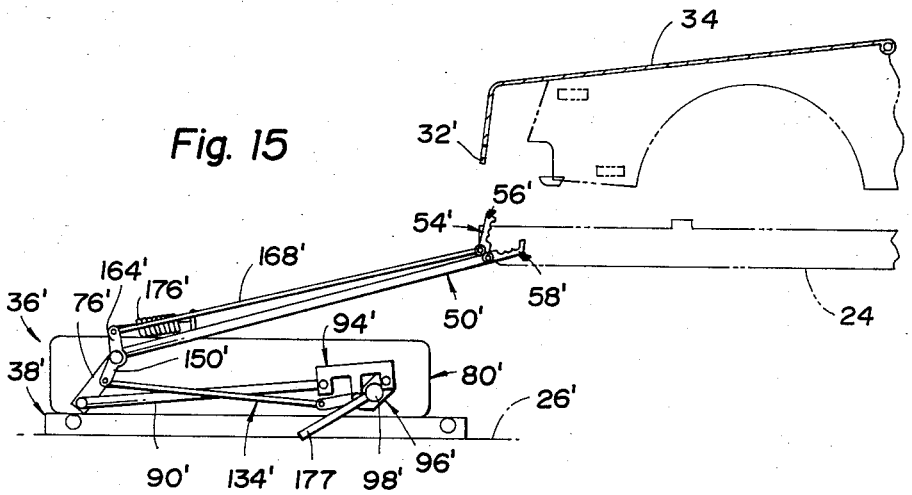
FIG. 15 is a diagram similar to FIG. 14 wherein the opener mechanism is shown in a position between its parked and pick-up positions.

When the vehicle body 20 is in its stationary position at the work station, the programmable controller 206 actuates the hydraulic manifold assembly 204 to rapidly raise the arm 50 from the parked position and slows down upon approaching the fixture engagement or pick-up position as shown in FIGS. 14 through 16 because the first-stage crank 96 goes into an over-center condition with drag links 94 and 90. The switch 210 is deactivated when the arm 50 leaves its parked position. As the gripper mechanism 54 on the arm 50 engages and begins to slowly raise the fixture 32, the floating arm 80 leaves its parked position, the switch 212 is deactivated and indicates to the controller 206 the fixture pick-up position. The fixture 32 slowly raises because at this time the bent crank 94 is substantially in-line with the drag link 90. The second stage of the harmonic drive engages and the gripper mechanism 54 begins to close. Preferably, approximately 20 centimeters above the fixture engagement point the fingers 56 and 58 of the gripper mechanism 54 are fully closed.

Figure 17:
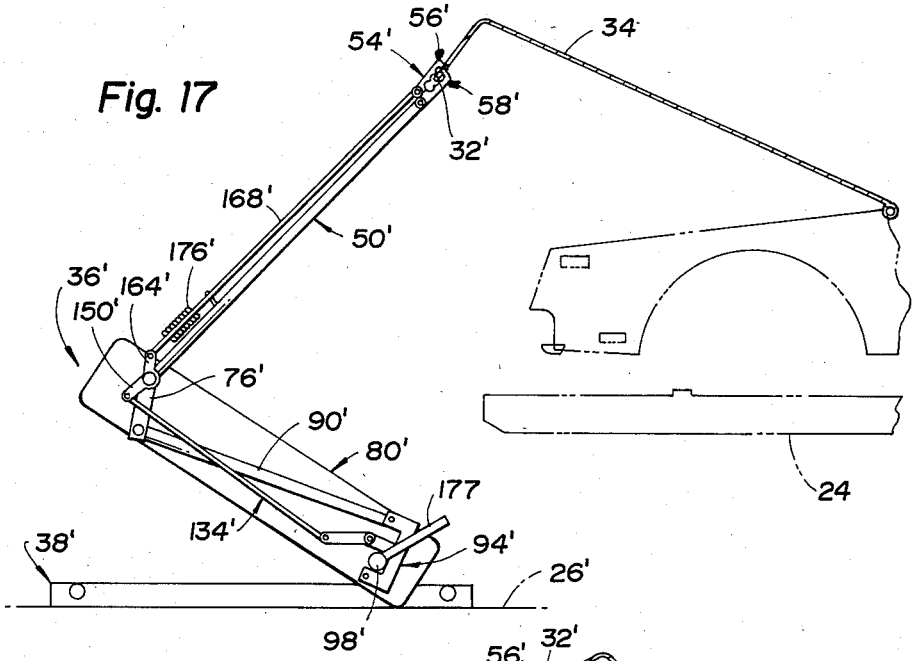
FIG. 17 is a diagram of the opener mechanism similar to the view of FIG. 14 with the opener mechanism in a position between its pick-up position and a full-open position.

Further rotary movement of the shaft 98 of the rotary actuator 108, as best shown in FIGS. 17 and 18 causes the closure to further accelerate until it reaches its maximum velocity near the midpoint between the fixture pick-up and full-open positions. The closure smoothly decelerates as it approaches the full-open position. During movement between the pick-up and full-open positions, the drag linkage 134 buckles. Just prior to the full-open position, the switch 214 is actuated and thereafter the hydraulics are turned off. The smooth deceleration is caused by the bent crank 94 going into an over-center condition with drag link 90.

Operation in the closing direction is similar to the operation in the opening direction. The hydraulics within the manifold assembly 204 are actuated by the programmable controller 206 opposite to the opening and the arm control linkage and the gripper control linkage move in the opposite direction. The bent crank 94 is constrained from leaving the stop 104 on the crank 96 by the track 126 as it engages the follower 120. The track 126 and the follower 120 also prevent buckling between the bent crank 94 and the drag link 90 during the closing operation. The arm 80 deactivates the switch 214 when it leaves the open position and activates switch 212 when it approaches its parked position. Subsequently, the arm 50 activates the switch 210 as the arm 50 moves into its parked position. Thereafter the hydraulics within the manifold assembly 204 are turned off by the controller 206.

The controls of each mechanism 36 and 36' are simple. Consequently, there are no requirements for introduction of high power level electrical circuits to the work station. Also, since the rotary actuator 108 is employed, no electrical, hydraulic, nor pneumatic lines need to be routed to any moving members of the mechanism 36. Because of these features the opener mechanism and the system of the present invention have a relatively low initial cost, yet are highly reliable and require low maintenance. The harmonic arm control linkage provides relatively smooth acceleration and deceleration between the fixture pick-up position and the full-open position of each cycle. During these two positions, substantially constant rotation of the actuator shaft 98 is translated into a nearly sinusoidal rotation of the arm 50.

Further, due to the floating arrangement of the arm 80 the mechanism 36 is able to operate vehicle closures with varying control paths with little modification and without any need for programming the paths.

While the invention has been described in an illustrative manner, it is to be understood that the terminology which has been used is intended to be in the nature of words of description rather than of limitation. Many modifications or variations of the present invention are possible in light of the above teachings. Therefore, it is to be understood that within the scope of the appended claims the invention may be practiced otherwise unless specifically described.

What is claimed is:

1. An apparatus for moving a closure of a vehicle body at a work station between open and closed positions along a path, the apparatus comprising:

a base;

a first arm mounted on said base for rotary movement about a first pivot axis;

a second arm mounted on said first arm for rotary movement about a second pivot axis between a parked position and a pick-up position corresponding to closed positions of the closure and for movement with the first arm between the pick-up position and a full-open position corresponding to the open position of the closure;

a gripper mechanism mounted on a free end of said second arm and adapted for receiving and releasing the closure in the pick-up position;

a motor including a rotatable actuator shaft; and arm control linkage connected to said actuator shaft for transferring and translating rotary motion of the actuator shaft at a substantially constant angular velocity to rotate said second arm between the parked and pick-up positions and to rotate the first and second arms between the pick-up and full-open positions at a substantially sinusoidal angular velocity wherein the gripper mechanism is accelerated and decelerated in a relatively smooth fashion as it follows the path of the closure between the open and closed positions after receiving the closure.

2. An apparatus for moving a closure of a vehicle body at a work station between open and closed positions along a path, the apparatus comprising:

a base;

a first arm having one end thereof mounted on said base for rotary movement about a first pivot axis;

a second arm having one end thereof mounted on the second end of said first arm for rotary movement about a second pivot axis between a parked position and a pick-up position corresponding to closed positions of the closure and for movement with the first arm between the pick-up position and a full-open position corresponding to the open position of the closure;

a gripper mechanism mounted on the free end of said second arm and adapted for receiving and releasing the closure in the pick-up position;

a motor including an actuator shaft rotatable about the first pivot axis; and arm control linkage connected to said actuator shaft for transferring and translating rotary motion of the actuator shaft at a substantially constant angular velocity to rotate said second arm between the parked and pick-up positions at a substantially sinusoidal angular velocity and to rotate the first and second arms between the pick-up and full-open positions wherein the gripper mechanism follows the path of the closure between the open and closed positions after receiving the closure.

3. An apparatus for moving a closure of a vehicle body at a work station between open and closed positions along an arcuate path, the apparatus comprising:

a base;

a first arm having one end thereof mounted on said base for rotary movement in a first direction about a first pivot axis;

a second arm parallel to the first arm and having one end thereof mounted on the second end of said first arm for rotary movement in a direction opposite the first direction about a second pivot axis spaced apart and parallel to the first pivot axis between a parked position and a pick-up position corresponding to closed positions of the closure and for movement with the first arm in the first direction between the pick-up position and a full-open position corresponding to the open position of the closure;

a gripper mechanism mounted on the free end of said second arm and adapted for receiving and releasing the closure in the pick-up position and adapted for pivotally retaining the closure between the pick-up and full-open positions;

a motor including an actuator shaft rotatable about the first pivot axis; and arm control linkage connected to said actuator shaft for transferring and translating rotary motion of the actuator shaft at a substantially constant angular velocity to rotate said second arm between the parked and pick-up positions at a substantially sinusoidal angular velocity and to rotate the first and second arms between the pick-up and full-open positions at a substantially sinusoidal velocity wherein the gripper mechanism is accelerated and decelerated in a relatively smooth fashion as it follows the path of the closure between the open and closed positions after receiving the closure.

4. An apparatus for moving a closure of a vehicle body at a work station between open and closed positions along a path, the apparatus comprising:

a base;

a first arm having one end thereof mounted on said base for rotary movement about a first pivot axis;

a second arm having one end thereof mounted on the second end of said first arm for rotary movement about a second pivot axis between a parked position and a pick-up position corresponding to closed positions of the closure and for movement with the first arm between the pick-up position and a full-open position corresponding to the open position of the closure;

a gripper mechanism mounted on the free end of said second arm for movement therewith and adapted for receiving and releasing the closure in the pick-up position;

a motor including an actuator shaft rotatable about a first pivot axis; and arm control linkage connected to said actuator shaft for transferring rotary motion of the actuator shaft to rotate said second arm between the parked and pick-up positions and to rotate the first and second arms between the pick-up and full-open positions, wherein said arm control linkage translates rotation of the actuator shaft at a substantially constant angular velocity to movement of said gripper mechanism along the path of the closure at a substantially sinusoidal velocity whereby the gripper mechanism is accelerated and decelerated to move the closure in a relatively smooth fashion after said gripper mechanism receives the closure.

5. The apparatus as claimed in claims 1 or 2 or 3 or 4 wherein said arm control linkage includes a first crank mounted on said actuator shaft for movement about the first pivot axis and wherein said second arm is accelerated and decelerated between the parked and pick-up positions to enable the gripper mechanism to gently receive and release the closure at the pick-up position.

6. The apparatus as claimed in claim 5 wherein said arm control linkage includes a bent second crank having one end thereof mounted on the first crank for pivotal movement about a third pivot axis between the parked and pick-up positions and wherein said first and second cranks rotate in unison about the first pivot axis between the full-open and pick-up positions to accelerate and decelerate the gripper mechanism in a relatively smooth fashion.

7. The apparatus as claimed in claim 6 wherein said arm control linkage includes a drive link having one end thereof connected to said second crank for pivotal movement about a fourth pivot axis.

8. The apparatus as claimed in claim 7 wherein said arm control linkage includes a drag link for interconnecting the one end of the drive link and the second end of the second crank, said drag link being aligned with the second crank in the pick-up position.

9. The apparatus as claimed in claim 7 including an output shaft, the opposite end of said drive link and the one end of said second arm being connected to said output shaft to rotate therewith.

10. The apparatus as claimed in claim 6 including a guide mechanism operatively associated with said second crank to cause said first and second cranks to rotate in unison during movement from the full-open position to the pick-up position.

11. The apparatus as claimed in claim 10 wherein said guide mechanism includes a track and a follower mounted on said second crank for movement along said track.

12. The apparatus as claimed in claims 1 or 2 or 3 or 4 wherein said gripper mechanism includes a pair of opposing fingers movable between open and closed positions and adapted to receive and pivotally retain therebetween at least a part of the closure.

13. The apparatus as claimed in claim 12 including gripper control linkage operatively associated with said arm control linkage to open and close said fingers in synchronism with the motion of said second arm.

14. The apparatus as claimed in claim 13 including a spring mechanism operatively connected at its opposite ends to said second arm and said gripper control linkage to bias said fingers closed during movement between the parked and pick-up positions.

15. The apparatus as claimed in claim 14 wherein said arm control linkage includes a first crank mounted on said actuator shaft for pivotal movement about the first pivot axis and a second crank having one end thereof mounted on the first crank for pivotal movement about a third pivot axis and wherein said gripper control linkage is connected to the second crank for pivotal movement about the first pivot axis to release the bias of the spring mechanism to enable the gripper control linkage to close the fingers during movement between the pick-up and full-open positions.

16. The apparatus as claimed in claim 15 wherein said gripper control linkage includes drag linkage having a joint, said drag linkage buckling at said joint upon closure of said fingers to accommodate excess control motion.

17. The apparatus as claimed in claims 1 or 2 or 3 or 4 wherein said base is adapted to be mounted at the work station so that the longitudinal axes of said first and second arms are substantially parallel to the path taken by the closure as the vehicle body moves into the work station.

18. The apparatus as claimed in claim 17 wherein said gripper mechanism includes a pair of fingers mounted for relative movement about a gripper axis and wherein said fingers receive and retain therebetween at least a part of the closure.

19. A system for opening and closing closures of vehicle bodies at a work station, the system comprising:

a base;

a first arm mounted on said base for rotary movement about a first pivot axis;

a second arm mounted on said first arm for rotary movement about a second pivot axis between a parked position and a pick-up position corresponding to closed positions of the closure and for movement with the first arm between the pick-up position and a full-open position corresponding to an open position of the closure;

a gripper mechanism mounted on a free end of said second arm and adapted for receiving and releasing the closure in the pick-up position;

a motor including a rotatable actuator shaft;

arm control linkage connected to said actuator shaft for transferring and translating rotary motion of the actuator shaft at a substantially constant angular velocity to rotate said second arm between the parked and pick-up positions and to rotate the first and second arms between the pick-up and full-open positions at a substantially sinusoidal angular velocity wherein the gripper mechanism is accelerated and decelerated in a relatively smooth fashion as it follows the path of the closure between the open and closed positions after receiving the closure;

control means for controlling the operation of the motor; and feedback means associated with said first and second arms for providing feedback signals to said control means.

20. The system as claimed in claim 19 wherein said feedback means includes a switch operatively associated with the second arm to indicate the parked position.

21. The system as claimed in claim 19 wherein said feedback means includes at least one switch operatively associated with said first arm to indicate the full-open and pick-up positions corresponding to open and closed positions, respectively, of the closure.

* * * * *